US005655687A

United States Patent [19]

Fitten et al.

[11] Patent Number: 5,655,687

[45] Date of Patent: Aug. 12, 1997

[54] BASE END DISPENSING CONTAINER WITH TRAVEL CAP

[75] Inventors: Timothy E. Fitten, Chaska, Minn.; Dieter F. Lay, Oconomowoc, Wis.; Thomas M. Bender, Reading, Pa.

[73] Assignee: Redmond Products, Inc., Chanhassen, Minn.

[21] Appl. No.: 476,858

[22] Filed: Jun. 7, 1995

[51] Int. Cl.[6] ..... B65D 37/00

[52] U.S. Cl. ..... 222/212; 222/185.1; 222/494; 222/546

[58] Field of Search ..... 222/95, 212, 185.1, 222/184, 494, 543, 545, 546, 538, 530; 215/306; 220/277

[56] References Cited

U.S. PATENT DOCUMENTS

| | | | |
|---|---|---|---|
| 1,426,846 | 8/1922 | Craig | 222/530 X |
| 4,969,581 | 11/1990 | Siefert et al. | 222/184 X |
| 5,033,655 | 7/1991 | Brown | 222/212 |
| 5,213,236 | 5/1993 | Brown | 222/185.1 |
| 5,337,877 | 8/1994 | Brown et al. | 222/105 |
| 5,339,995 | 8/1994 | Brown et al. | 222/185.1 |
| 5,388,712 | 2/1995 | Brody | 222/538 X |
| 5,409,144 | 4/1995 | Brown | 222/185.1 |
| 5,439,143 | 8/1995 | Brown et al. | 111/185.1 |
| 5,542,586 | 8/1996 | Stockwell | 222/538 |

OTHER PUBLICATIONS

Closure A as shown in photographs 1–2, (prior art).
Closure B as shown in photographs 1–3, (prior art).
Closure C as shown in photographs 1–3, (prior art).

*Primary Examiner*—Gregory L. Huson
*Attorney, Agent, or Firm*—Kinney & Lange, P.A.

[57] ABSTRACT

The present invention relates to a dispensing container having an inner cavity for storing content to be dispensed, such as bath and beauty products. Content is dispensed when the container is squeezed through a dispensing valve. The container is supported in an inverted position so that the dispensing valve is at a base or dispensing end of the container. Accordingly, when the dispensing container is supported in an upright position by the base, bath products stored in the inner cavity gravitate toward the dispensing valve for immediate release. A travel cap seals the dispensing valve for transport. The travel cap is selectively attached to a closed end of the container when the container is in use and the dispensing end of the container to seal the dispensing valve for transport.

20 Claims, 6 Drawing Sheets

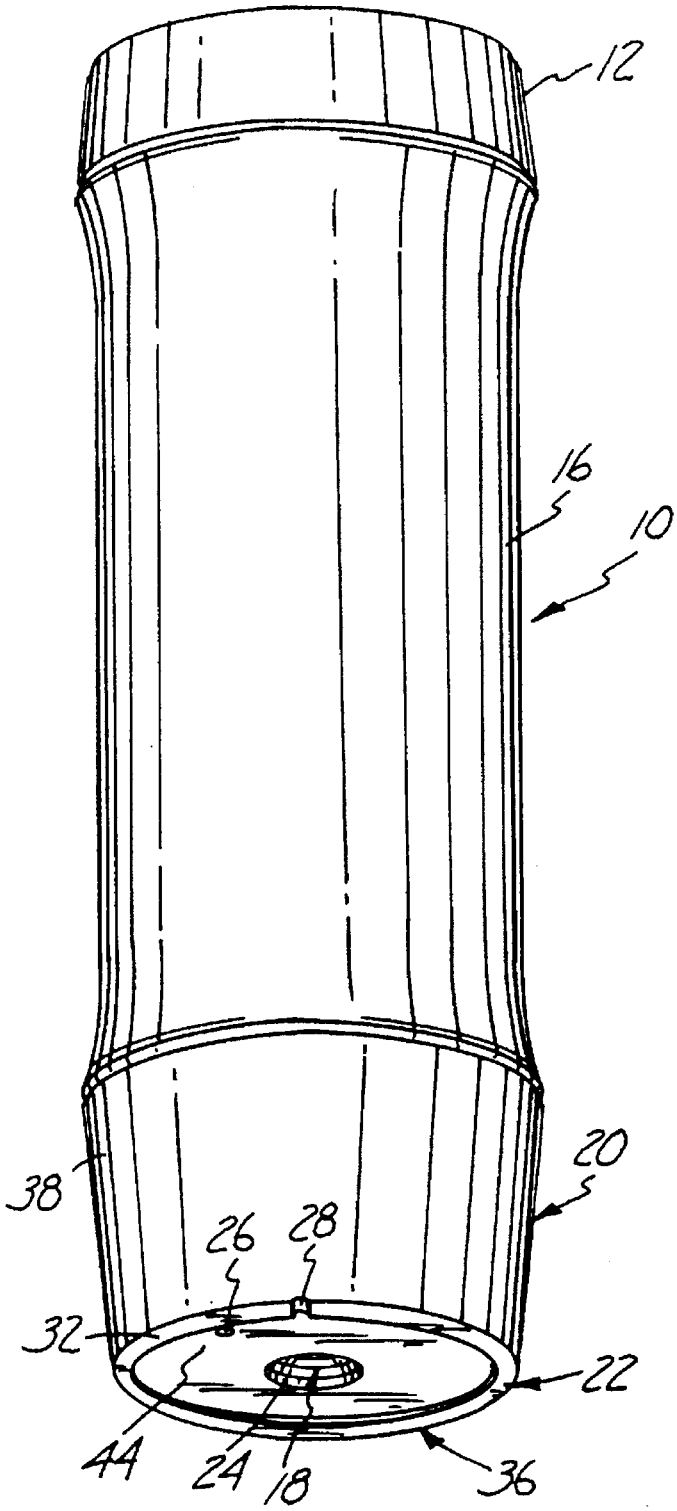
Fig. 1
Fig. 2
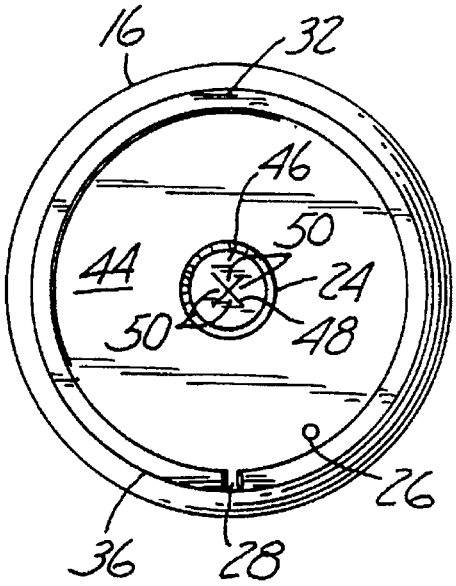

58
12
62
60

10
23
52
54
77
16
18
80
40
34
20
42
89
38
86
36

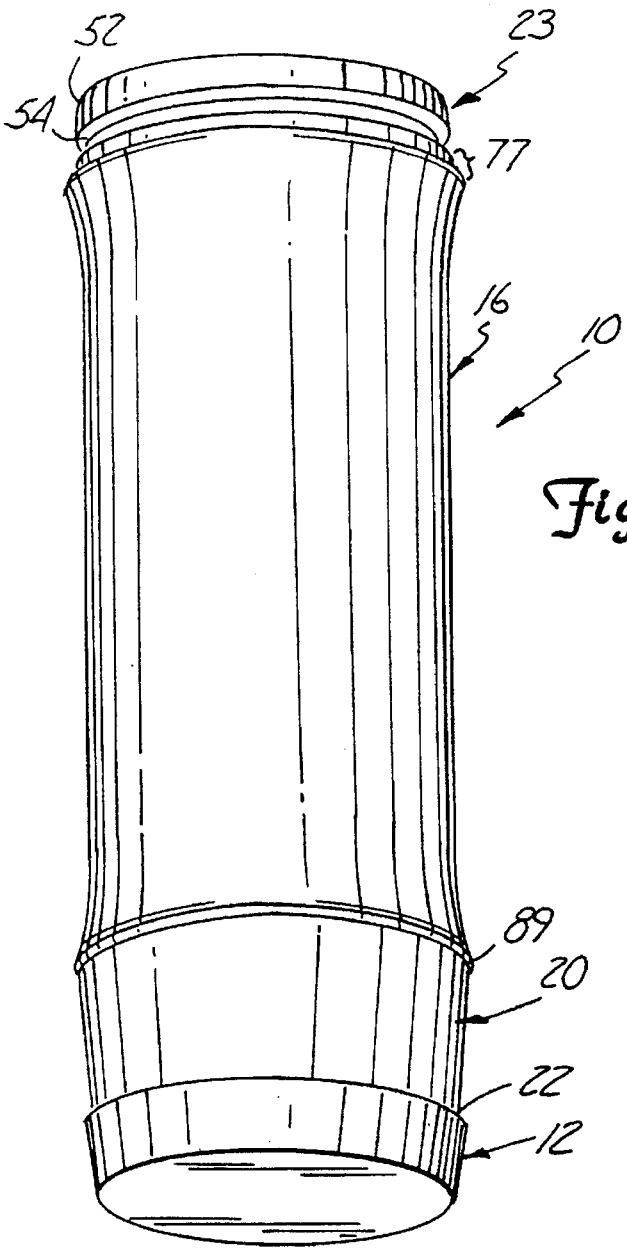
Fig. 3
Fig. 4
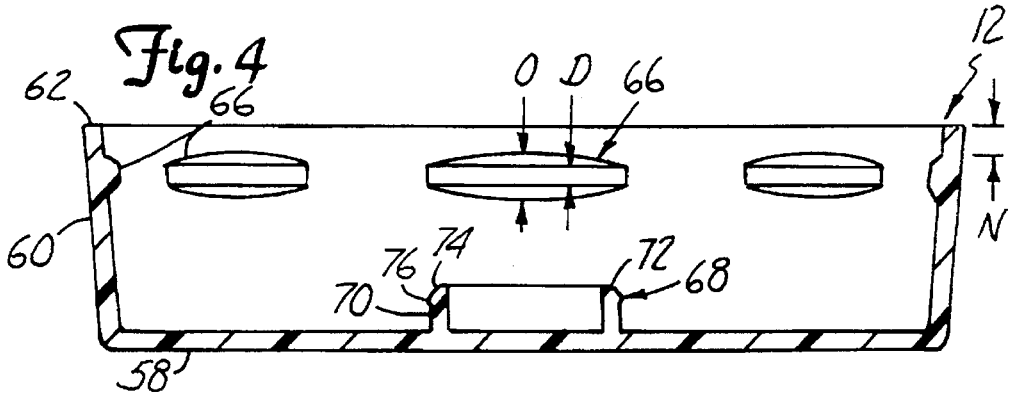

F
G
I
23
K
52
54
78
J
H
77
B
16
A
80
79
E
40
82A
D
B
C
89
82
38
82B
20
86
L
93
42
108
88
114
112
116
110
100
46
18
62
38
34
66
96
106
48
12
122
M
26
98
118
124
60
104
74
32
36
120
70
72
24
76
58

BASE END DISPENSING CONTAINER WITH TRAVEL CAP

REFERENCE TO CO-PENDING APPLICATION

Reference is hereby made to the following commonly assigned, co-pending application entitled DISPENSING CONTAINER WITH DRAINAGE PASSAGES (Ser. No. 08/477,534) filed on even date.

BACKGROUND OF THE INVENTION

This invention relates to a container and, more particularly, to a dispensing container for selectively dispensing flowable material for use.

Dispensing containers are known for holding flowable materials, such as bath products, shampoos, conditioners and soaps. Such containers typically have a base for supporting the container and an opening at the opposite end of the base for dispensing product from an inner cavity of the container. A cap usually secures the container during periods of non-use.

In most containers, flowable material gravitates toward the base, which is at the opposite end of the opening of the container. In such containers, when the container is completely filled, material in the container may be easily dispensed through the opening of the container. However, when the container is nearly empty, it is difficult to dispense material which is seated at the base opposite the opening. The user must pound and shake the container to empty the container. This process is particularly frustrating when one is in the process of showering and has to wait a long time for shampoo or soap to be dispensed.

If a container is designed so that the dispensing opening is at the base of the container where the container is supported, the content, such as shampoo or soap, may be dispensed more readily. In such a container, it is desirable to regulate flow of content from the container for use. It is also desirable that the container be constructed so that the content may be readily dispensed, for example, during showering, without fumbling with caps or covers. It is also desirable that the container have an effective means to seal the container for transport while not in use.

SUMMARY OF THE INVENTION

The present invention relates to an inverted dispensing container for selectively dispensing flowable material, such as shampoo and soap for use. The dispensing container is an elongated flexible container having an inner cavity for storing content which is to be dispensed from the container. The container includes a dispensing valve at an opening of the container. The valve is open when the container is squeezed to release material or contents from the inner cavity. The valve remains closed until the container is squeezed to restrict the flow of the material from the container.

The container is supported by a base which is located at the same end as the valve. Since the container is supported at its base, material or content in the inner cavity of the container gravitates towards the valve. When pressure is applied to the container, material is dispensed fairly quickly even when the container is not completely full since material does not need to flow from a base at the opposite end of the container. The dispensing container includes a travel cap for sealing the valve. The cap is supported at a closed end of the container (opposite the dispensing valve and base) during use of the dispensing container. During transport, the cap is moved from its normal position at the closed end, to a position where it seals the valve at the base of the container.

In a preferred embodiment, the cap is a cup-shaped member having a face and a generally cylindrical wall extending therefrom to define an interior cavity. The closed end of the container fits into the interior cavity of the cap. The cap includes lugs which correspond to a circumferential groove at the closed end of the container to snap fit the travel cap to the closed end of the container. This allows the cap to be stored when not in use so that the cap is not lost. The base of the container also fits into the interior of the travel cap to seal the valve for transport so that content will not leak out of the container if the container is inadvertently squeezed during transport.

In a preferred embodiment, the valve is formed of a silicone membrane having a cross-shaped slit therethrough. The cross-shaped slit forms a plurality of flaps which open and close when pressure is applied to the container. In the open position, the flaps allow content to flow through the slit of the silicone membrane. In the closed position, the flaps prohibit the flow of content through the slit of the silicone membrane.

BRIEF DESCRIPTION OF THE DRAWINGS

FIG. 1 is perspective view of the dispensing container of the present invention shown with a travel cap supported at a closed end of the container.

FIG. 2 is a plan view of a dispensing end of the container of FIG. 1 illustrating a dispensing valve.

FIG. 3 is a perspective view of the dispensing container similar to FIG. 1 with the travel cap shown sealing the dispensing valve for transport.

FIG. 4 is a cross-sectional view of the travel cap.

DETAILED DESCRIPTION OF THE PREFERRED EMBODIMENTS

Figure 1A:
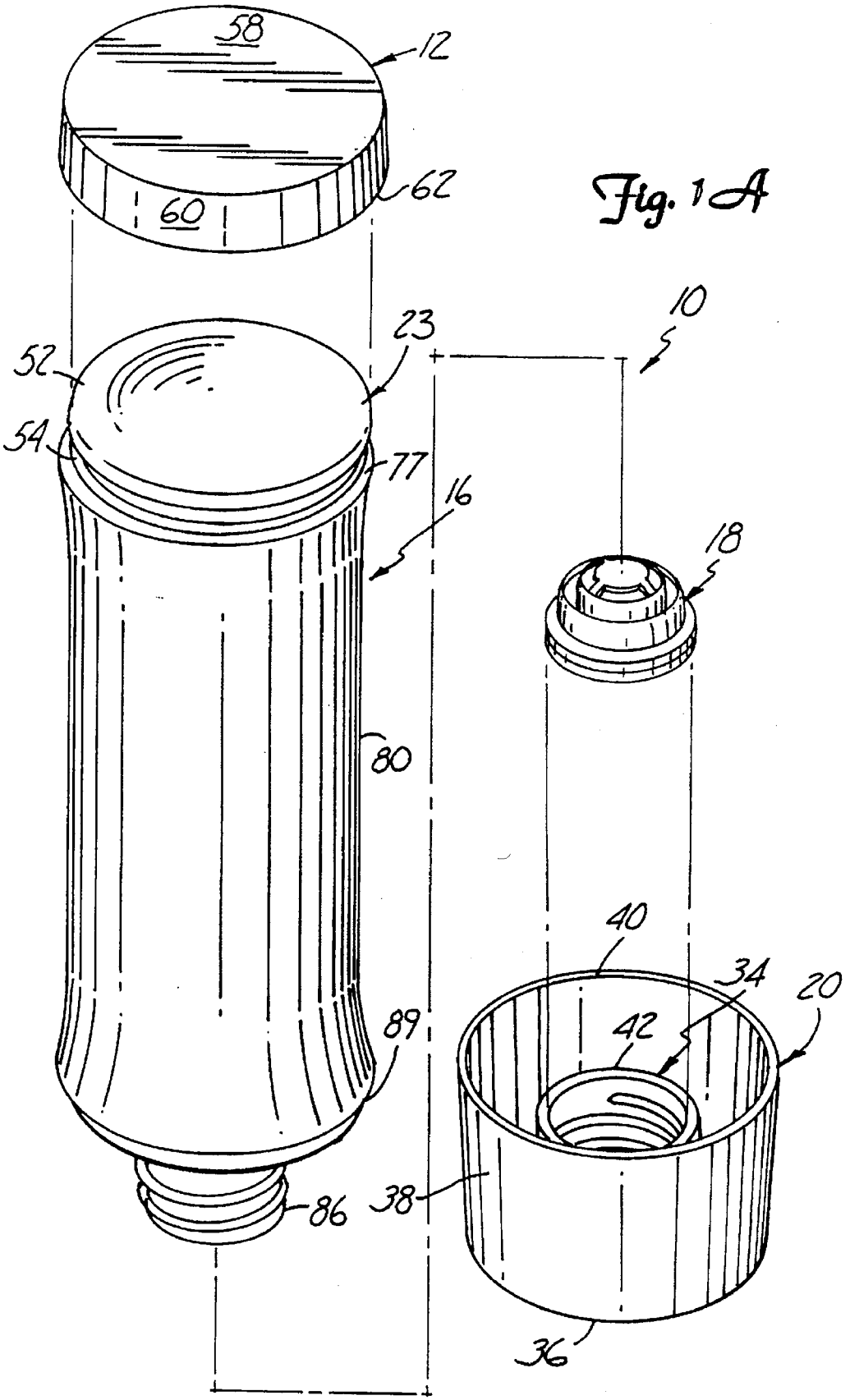
FIG. 1A is an exploded view of the dispensing container as shown in FIG. 1.

FIGS. 1–3 disclose a dispensing container 10 of the present invention. As shown, more clearly in FIG. 1A, dispensing container 10 includes a travel cap 12, a bottle 16, a dispensing valve 18, and base cap 20. The dispensing valve 18 selectively dispenses flowable content such as soap, shampoo and other health and beauty products from the bottle 16 of the container 10 when the bottle 16 is squeezed. The valve 18 restricts the flow of content from the bottle 16 when the bottle 16 is not being squeezed.

As shown in FIG. 1, the base cap 20 and dispensing valve 18 are both at a dispensing end 22 of the container 10 so that the base cap 20 supports the container 10 in an upright inverted position as shown in FIG. 1 to define the base of the container. In the upright position, gravity forces the contents in the dispensing container 10 toward the dispensing valve 18 for immediate discharge when pressure is applied to the container 10. Thus, there is no need, while showering for example, to shake the bottle or wait for contents to slowly flow towards the bottle opening under the force of gravity. This feature is particularly useful as the container is emptied, since it would take longer and longer for content to be dispensed if the container were supported at the opposite end of a dispensing opening.

As shown comparatively in FIGS. 1 & 3, travel cap 12 is selectively positioned at a closed end 23 of the bottle 16 of the container 10 (FIG. 1) and at the dispensing end 22 (FIG. 3). The travel cap 12 is positioned at the closed end 23 as shown in FIG. 1 when content is to be dispensed through the dispensing valve 18 and at the dispensing end 22 to seal the dispensing valve 18 for transport as shown in FIG. 3.

As shown in FIGS. 1 and 1A, the base cap 20 is frustoconical shaped and includes a through opening 24, a drain hole 26, a drain slot 28, a rim ridge 32 and a threaded receptacle 34 (shown in FIG. 1A). As shown in FIG. 1A, the base cap 20 is formed of a cup-like member having a circular face 36, a sloped cylindrical side wall 38 and a rim 40 defining a housing structure. The side wall 38 extends from the circular face 36 and is sloped outwardly so that the diameter of the rim 40 is larger than the diameter of the circular face 36. The threaded receptacle 34 includes a threaded cylindrical wall 42 which extends essentially perpendicularly from face 36.

As shown in FIGS. 1 and 2, rim ridge 32 of base cap 20 circumferentially extends about an outer periphery of the face 36 to define an elevated support ridge and a recessed end surface 44. The drain slot 28 extends through the rim ridge 32 between the recessed end surface 44 and an outer surface of the container 10 to fluidly connect the end surface 44 to the outer surface of the container 10. The drain slot 28 allows for drainage of fluid trapped under the rim ridge 32 when the dispensing container 10 is supported by the base cap 20, so that mildew and other bacteria is not allowed to grow and collect between the recessed end surface 44 and the rim ridge 32.

As shown in FIG. 2, the dispensing valve 18 is formed of a silicone membrane 46 including a cross-shaped slit 48. The cross shaped slit 48 is cut through the silicone membrane 46 to define a plurality of relatively small flaps 50. The flaps 50 are aligned parallel to the silicone membrane 46 to define a closed position for the dispensing valve 18. To release flowable content, the flaps 50 open such that the flaps 50 are angled relative to the silicone membrane 46 to define an open position for the dispensing valve 18.

As shown in FIGS. 1A & 3, the closed end 23 of the container 10 includes a lip 52 and a circumferential groove 54. FIG. 4 is a cross sectional view of the travel cap 12. The travel cap 12 is formed of a cup-shaped member having a circular face 58, a cylindrical wall 60, and a rim 62. The cylindrical wall 60 extends from the periphery of the face 58. The wall 60 is sloped from the face 58 toward rim 62, to define a larger diameter for the rim 62 than the face 58. The rim 62 and wall 60 are sized to allow the closed end 23 of the container 10 to be inserted into the interior of the travel cap 12.

The travel cap 12 includes a plurality of lugs 66 (which extend about an inner surface of the cylindrical wall 60) and a plug 68. The plug 68 includes a circular ring 70 and a lip 72. The circular ring 70 extends essentially perpendicularly from the face 58 of the travel cap 12. Lip 72 extend about the periphery of the ring 70 and includes a sloped insertion face 74 and a sloped release face 76.

Figure 5:
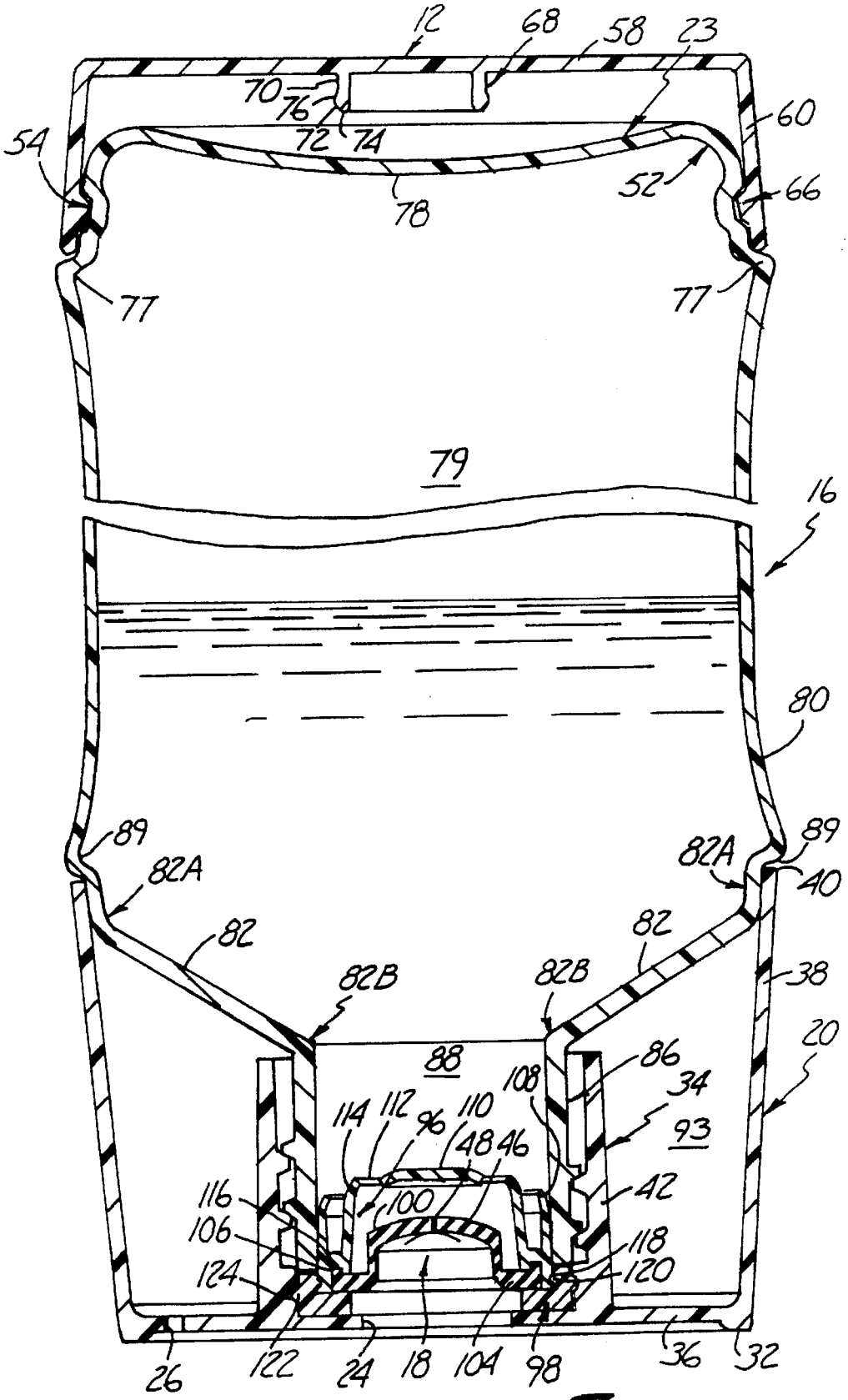
FIG. 5 is a cross-sectional view of the dispensing container, similar to FIG. 1, with the travel cap being supported at the closed end.
Figure 6:
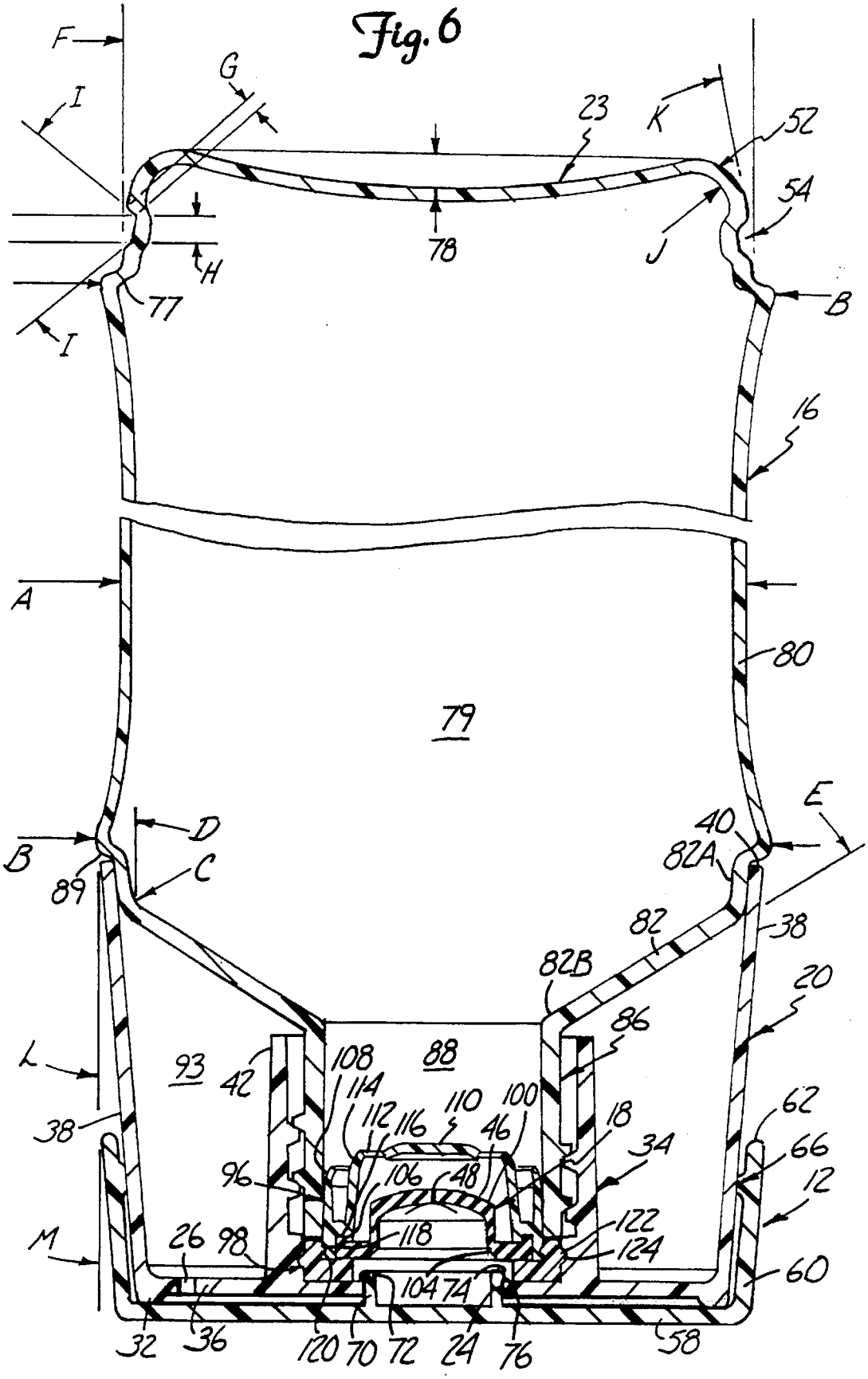
FIG. 6 is a cross-sectional view of the dispensing container, similar to FIG. 3, with the travel cap shown sealing the dispensing valve for transport.

FIGS. 5 and 6 are cross-sectional views of the container 10 of FIGS. 1 and 3, respectively. FIG. 5 illustrates the dispensing container 10 with the travel cap 12 supported at the closed upper end 23. FIG. 6 is a cross-sectional view of the dispensing container 10 with the travel cap 12 sealing the dispensing valve 18 at the dispensing end 22. The travel cap 12 is secured to the closed end 23 as shown in FIG. 5 by cooperation of the lugs 66 of the travel cap 12 and the circumferential groove 54 extending about the periphery of the closed end 23. Lip 52 is a curvedly shaped end about the periphery of the closed end 23. Lip 52 flexes the cylindrical wall 60 of the travel cap 12 as the travel cap 12 is forced onto the closed end 23 of the dispensing container 10 to snap fit the lugs 66 into groove 54 of the dispensing container 10.

A recessed ledge 77 between the bottle 16 and the closed end 23 of the dispensing container 10 accommodates the rim 62 of the travel cap 12. The recessed ledge 77 is dimensioned similar to the thickness of the wall 60 of the travel cap 12 to accommodate the travel cap 12.

To release the travel cap 12 from the closed upper end 23, the user pulls and gently twists the travel cap 12 from the closed end 23 to force the travel cap 12 about the curvedly shaped lip 52 to release the lugs 66 of the travel cap 12 from groove 54 of the closed end 23. As shown in FIG. 5, the lugs 66 of travel cap 12 are positioned a sufficient distance from the face 58 of the travel cap 12 to allow for clearance between an end face of the closed end 23 and the plug 68 of the travel cap 12. As shown, the end face of the closed end 23 is concave-shaped having a center dip 78.

As shown in FIGS. 5 and 6, the bottle 16 of the dispensing container 10 includes an inner cavity 79, a main container segment 80, shoulder 82, having an upper and lower portion 82A and 82B, a threaded neck 86 and mouth 88. Flowable content is filled into the inner cavity 79 of the main container segment 80 of the bottle 16 through mouth 88. The main container segment 80 is generally cylindrically and slightly concave-shaped. The neck 86 has a smaller diameter than the main container segment 80 and is connected to the main container segment 80 by the shoulder 82. Upper shoulder portion 82A is adjacent to the main container segment 80 and the lower shoulder portion 82B is adjacent to the neck 86. A recessed ledge 89 connects the main container segment 80 to the upper shoulder portion 82A.

The base cap 20 is screwed to the bottle 16 to form the dispensing container 10 via cooperation of the threaded receptacle 34 of the base cap 20 and the threaded neck 86 of the bottle 16. The depth of the base cap 20 is sufficient so that when the neck 86 of the bottle 16 is inserted into receptacle 34 of the base cap 20, the housing (face 36 and cylindrical wall 38) of the base cap 20 encloses the neck 86 and shoulder 82 of the bottle 16 to provide a cover structure for the threaded neck 86 and shoulder 82 of the bottle 16.

The through opening 24 of the base cap 20 is smaller than the mouth 88 of the bottle 16 and aligned therewith when the base cap 20 is screwed to bottle 16 to define the dispensing opening. Fluid is dispensed from the inner cavity 79 of the bottle 16 through the dispensing opening (mouth 88 of the bottle 16 and through opening 24 of the base cap 20). The dispensing valve 18 is seated in the mouth 88 of the bottle 16 to regulate flow of content, such as shampoos and soaps from the inner cavity 79 through the dispensing opening.

The rim 40 of the base cap 20 abuts against the upper shoulder portion 82A and recessed ledge 89 of the bottle 16. The recessed ledge 89 is sized relative to the width of the cylindrical side wall 38 of the base cap 20 to provide a smooth transition of the housing of the base cap 20 and the main container segment 80 of the bottle 16.

The enclosure of the base cap 20 about the neck 86 and the shoulder 82 of the bottle 16 defines a base cavity or housing cavity 93. When the container 10 is used to dispense shampoos, soaps and other bath products, and the container 10 is used in the shower, water may seep through the abutment of the rim 40 of the base cap 20 and the bottle 16 at the upper shoulder portion 82A into the base cavity 93. Drain hole 26 extends through face 36 of the base cap 20 to allow fluid trapped in the base cavity 93 to drain so that mildew and bacteria do not grow.

FIG. 6 illustrates the travel cap 12 attached to the base cap 20 to seal the container 10 for transport. The interior of the travel cap 12 is sized to fit over a lower portion of the base cap 20 and the lugs 66 of travel cap 12 frictionally grip the outer surface of the wall 38 of the base cap 20. The ring 70 of the plug 68 is formed of a flexible material and is sized for insertion into through opening 24 of the base cap 20 to seal the opening 24. The lip 72 overhangs from the ring 70 so that the diameter of the lip 72 is slightly larger than the through opening 24. The height of the ring 70 between the face 58 of the cap 20 and lip 72 is sized so that the ring 70 extends through opening 24 and the lip 72 engages an inner surface of the face 36 of the base cap 20 to snap fit the travel cap 12 to the base cap 20 of the container 10.

The sloped insertion face 74 (best shown in FIG. 4) of lip 72 allows for insertion of the circular ring 70 and lip 72 through the through opening 24. To insert, the user pushes the travel cap 12 over the base cap 20 so that the circular ring 70 and lip 72 pass through opening 24 of the base cap 20. The sloped insertion face 74 contacts the base cap 20 at the through opening 24 to slightly flex the ring 70 for insertion of the ring 70 and lip 72 through the through opening 24. The sloped release face 76 (best shown in FIG. 4) is slightly sloped to facilitate removal of the travel cap 12. The sloped release face 76 flexes the ring 70 as the cap 12 is pulled from the base cap 20 so that the ring 70 and lip 72 may be slid through the through opening 24 for removal of the cap 12.

Figure 7:
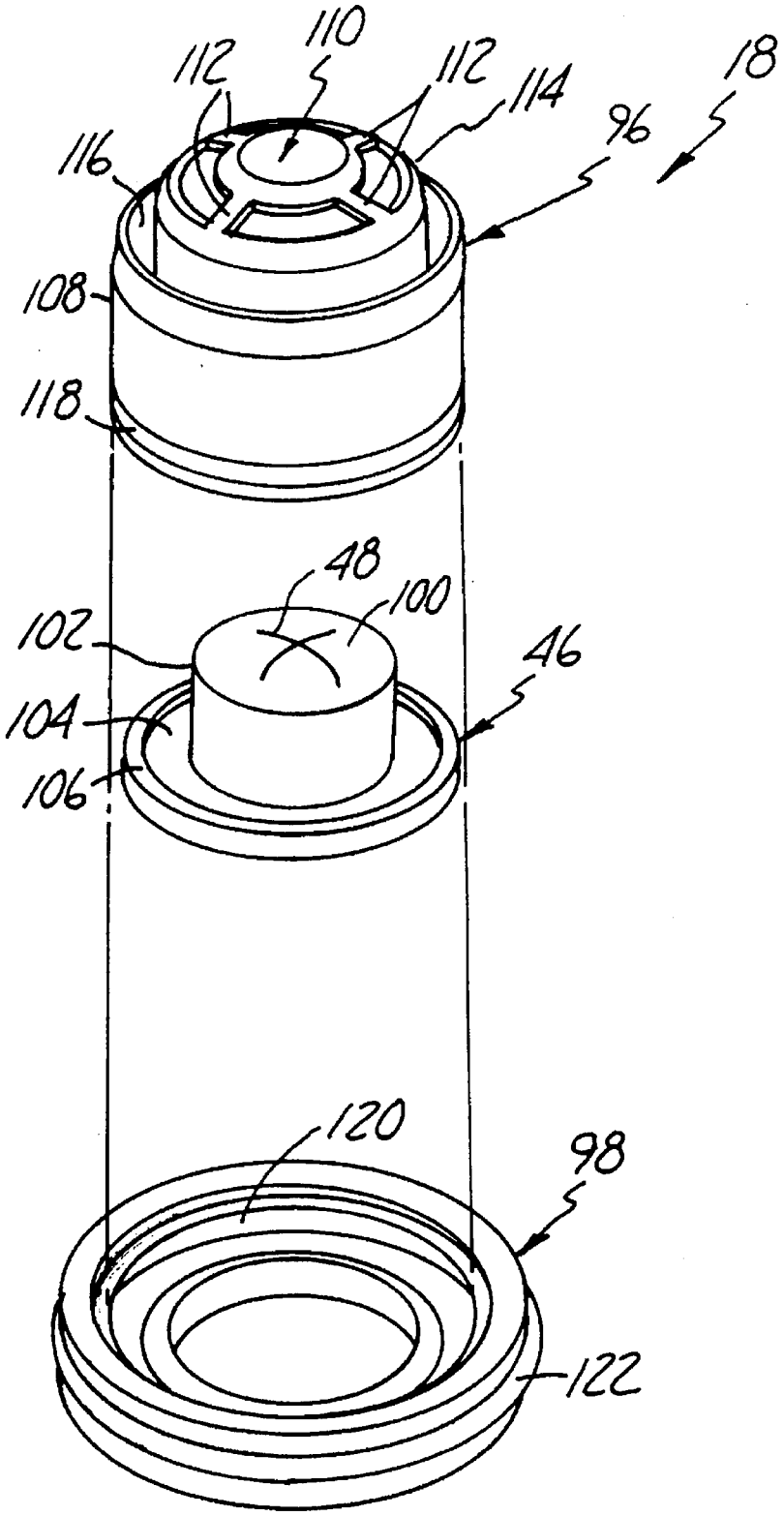
FIG. 7 is an exploded detailed view of the dispensing valve.

Dispensing valve 18, as shown in relation to FIGS. 5–7, includes the silicone membrane 46, and a first ring support 96 and a second ring support 98. The silicone membrane 46 is supported between the first ring support 96 and the second ring support 98. As shown in FIG. 7, the silicone membrane 46 is preformed into a cup-like member having a base 100, cylindrical wall 102, a support ledge 104, and flange 106. The cylindrical wall 102 extends from the base 100. The support ledge 104 extends perpendicularly from an open end of the cylindrical wall 102 (opposite the base 100) about the periphery thereof. Flange 106 extends essentially perpendicularly from ledge 104. The cross slit 48 is stamped at the base 100 of the cup-like member.

The first ring support 96 includes a flexible fit ring 108, a flow gate 110, flow gate support legs 112, a flow gate support ring 114, recess 116 (shown in FIGS. 5 & 6) and ring groove 118. The second ring support 98 includes ring ridge 120 and tongue 122. As best shown in FIGS. 5–6, recess 116 of the first ring support 96 is sized to accommodate and is aligned with flange 106 of the silicone membrane 46. Ring ridge 120 of the second ring support 98 snap fits into ring groove 118 of the first ring support 96 to connect the first and second ring supports 96 and 98 to support the ledge 104 of the silicone membrane 46 therebetween.

The fit ring 108 of the first ring support 96 is dimensioned similar to the mouth 88 of the bottle 16. When assembled, the first ring support 96 is inserted into the mouth 88 so that the fit ring 108 fictionally engages the neck 86 of the bottle 16 to secure the dispensing valve 18 relative to the mouth 88 of bottle 16.

The second ring support 98 is dimensioned similar to an outer surface of the neck 86 of the bottle 16. When assembled, the second ring support 98 is seated at an opened end of the neck 86 of the bottle 16. As shown in FIGS. 5 & 6, when the base cap 20 is screwed to the neck 86 of the bottle 16, a portion of the face 36 and a portion of the cylindrical wall 42 of the receptacle 34 of the base cap 20 abut against the second ring support 98 to the lock the dispensing valve 18 within the mouth 88 of the bottle 16. The second ring support 98 includes a circular tongue 122 which is sized to insert into a corresponding circumferential groove 124 formed about the cylindrical wall 42 of the receptacle 34 of the base cap 20.

The flow gate 110 is a circular plate dimensioned smaller than the diameter of the base 100 of the silicone membrane 46. The flow gate 100 is supported adjacent to the silicone membrane 46 in the mouth 88 of the bottle 16 to control the flow force of content directly toward the slit 48 to prevent unwanted seepage through the slit 48 of the silicone membrane 46. The flow gate 110 is supported by the first ring support 96 by the flow gate support ring 114. Legs 112 connect the flow gate 110 to the flow gate support ring 114. The legs 112 are spaced to allow fluid to flow past the flow gate 110 to be dispensed through the dispensing opening.

When the container 10 is supported by the base cap 20, fluid flows towards the silicone membrane 46. When pressure is applied to the container 10, the cup-like silicone membrane 46 inverts (not shown) and is forced outward and the flaps 50 of the valve 18 open (not shown) to release content from the inner cavity 79. When pressure is released the cup-like silicone membrane 46 reinverts as shown and the flaps 50 dose to restrict the flow of content.

The cap 12, bottle 16 and base cap 20 are preferably formed of a high density polyethylene material. The silicone membrane 46 and slit 48 are dimensioned to restrict flow of content from the inner cavity 79 of the container 10 until the container 10 is squeezed to dispense content.

As shown in FIG. 6, a dispensing container 10, having a longitudinal axis along an extent of the container and a diametric axis perpendicular to the longitudinal axis, may be constructed according to the present invention as follows. The bottle 16 of the container includes a main container segment 80 having a center portion having a diameter A of approximately 2.1 inches and opposed end portions having a diameter B of approximately 2.25 inches to define the concaved shape therefor. The neck 86 of the bottle 16 has an outer diameter of approximately 0.85 inches and the mouth 88 of the bottle 16 has a diameter of approximately 0.72 inches.

The upper shoulder portion 82A, adjacent the recessed ledge 89 includes a rounded edge having a radius C of approximately 0.1 inches and is slightly sloped, at an angle D of approximately 5 degrees relative to the longitudinal axis toward the lower shoulder portion 82B. The diameter of the upper shoulder portion 82A at the recessed ledge 89 is approximately 2.1 inches. The shoulder 82 is sloped between the upper shoulder portion 82A and the lower shoulder portion 82B at an angle E of about 30 degrees relative to the diametric axis of the bottle 16 to connect the main container segment 80 and the neck 86 of the bottle 16.

The diameter F of the closed end 23 is approximately 2.1 inches. The sides of the groove 54 of the closed end 23 have a length G of approximately 0.04 inches, and the width H of a base of the groove 54 is approximately 0.05 inches. The sides of the groove 54 are formed at an angle I of about 45 degrees, relative to the diametric axis of the bottle 16. The lip 52 of the closed end 23 includes a rounded end having a radius J of approximately 0.15 inches and a side edge which is sloped inwardly from the groove 54 at an angle K of approximately 5 degrees relative to the longitudinal axis of the bottle 16. The center dip 78 of the closed end 23 has approximately a 0.1 inch depth. The overall height of the bottle 16 is approximately 6.2 inches. The height of the main container segment 80 is approximately 4.62 inches, shoulder 82 is approximately 0.55 inches, neck 86 is approximately 0.65 inches, closed end 23 is 0.40 inches and lip 52 is approximately 0.19 inches. The height of shoulder portion 82A is approximately 0.19 inches.

The diameter of the through opening 24 of the base cap 20 is approximately 0.47 inches and the diameter of the rim 40 of the base cap 20 is 2.2 inches. The thickness of cylindrical sidewall 38 is approximately 0.045 inches. The height of the base cap 20 is 1.375 inches and the height of the wall 42 of the receptacle 34 is approximately 0.8 inches. The height of the base cap 20 and the extent of the wall 42 of the receptacle 34 accommodate for the valve 18 and allow the rim 40 of the base cap 20 to seat at the recessed ledge 89 of the bottle 16. The wall 38 of the base cap 20 is sloped outwardly from the face 36 toward rim 40 at an angle L of about 5 degrees relative to the longitudinal axis. The height of the rim ridge 32 at the periphery of the face 36 of the base cap 20 is approximately 0.025 inches. Preferably, the drain hole is approximately 0.080 inches in diameter. The width of the drain slot 28 is approximately 0.1 inches.

The diameter of the travel cap 12 at the rim 62 is approximately 2.2 inches. The height of the travel cap 12 is approximately 0.575 inches. The wall 60 of the travel cap 12 is sloped outwardly from the face 58 to the rim 62 at an angle M of 5 degrees relative to the longitudinal axis. The height of the ring 70 and lip 72 of plug 68 is approximately 0.125 inches. As shown in FIG. 4, the lugs 66 are positioned a distance N of approximately 0.0625 inches below the rim 62 of travel cap 12. The thickness O of the lugs 66 is approximately 0.11 inches and thickness P of the lugs 66 is approximately 0.05 inches.

CONCLUSION

Thus, there has been described an inverted dispensing container 10 which is supported at the same end as the through opening 24 and a dispensing valve 18 which regulates flow of content from the inner cavity 79 of the container 10. The dispensing container 10 includes a travel cap 12 which snap fits to the closed end 23 of the container 10 for normal operation. When the container 10 is used in a shower or bath, the travel cap 12 fits on the closed end 23 of the container out of the way of the dispensing valve 18 so that once the container is squeezed, content will be dispensed from the inner cavity 79. Since the travel cap 12 snap fits to the closed end 23 of the container 10, it will not be lost during non-use of the travel cap 12. For transport or travel, the plug 68 of the travel cap 12 fits relative to the through opening 24 of the base cap 20 to seal the valve 18 so that contents will not leak from the container 10 during transport.

Although the present invention has been described with reference to preferred embodiments, workers skilled in the art will recognize that changes may be made in form and detail without departing from the spirit and scope of the invention.

What is claimed is:

1. A dispensing container comprising:

an elongated relatively flexible container having an inner cavity for storing material, said container having a dispensing end and an upper closed end, the dispensing end including a base for supporting the container in an upright position and a dispensing opening for dispensing material from the inner cavity;

a valve positioned relative to the dispensing opening for regulating the flow of material from the inner cavity, the valve having an opened position and a closed position; in the opened position, the valve allowing material to flow from the inner cavity through the dispensing opening for discharge, and in the closed position, the valve prohibiting the flow of material from the inner cavity through the dispensing opening;

a travel cap for sealing the valve;

means for selectively attaching the travel cap to the closed end of the container; and means for selectively attaching the travel cap over the dispensing end of the container and over the dispensing opening for sealing the valve.

2. The dispensing container of claim 1 wherein the travel cap is formed of a cup-shaped member having a face and a cylindrical wall extending from the face to define an interior of the travel cap, the interior of the travel cap being sized for insertion over the dispensing end and the closed end of the container.

3. The dispensing container of claim 2 wherein the means for selectively attaching the travel cap to the closed end of the container comprises:

lugs about an inner surface of the cylindrical wall of the travel cap;

a circumferential groove about the periphery of the closed end of the container, the lugs of the travel cap being sized to fit into the groove to secure the travel cap to the closed end of the container; and a lip about the periphery of the closed end of the container for flexing the cylindrical wall of the travel cap for snap-fitting the lugs of the travel cap into the groove of the closed end of the container.

4. The dispensing container of claim 1 wherein the travel cap includes a plug, the plug being sized for insertion into the dispensing opening for sealing the valve.

5. The dispensing container of claim 4 wherein the plug of the travel cap includes a lip which is sized slightly larger than the dispensing opening for sealing the valve.

6. A dispensing container comprising:

a bottle having a cylindrically shaped main container segment defining an inner cavity for storing material, an upper closed end, a cylindrically shaped neck having a diameter smaller than the diameter of the main container segment, and a shoulder portion connecting the main container segment and the neck, the neck having a mouth;

a base cap including a circular face with a through opening and a cylindrical wall extending from the face to define an interior cavity, the wall and face being sized so that the bottle fits into the interior cavity of the base cap and the wall and face enclose the neck and shoulder of the bottle, the through opening of the base cap being aligning with the mouth of the bottle to define a dispensing opening for the container;

means for attaching the base cap to the bottle;

a valve positioned relative to the dispensing opening for regulating the flow of material from the inner cavity, the valve having an opened position and a closed position; in the opened position, the valve allowing material to flow from the inner cavity through the dispensing opening for discharge, and in the closed position, the valve prohibiting the flow of material from the inner cavity through the dispensing opening;

a travel cap for sealing the valve;

means for selectively attaching the travel cap to the closed end of the bottle; and means for selectively attaching the travel cap to the circular face of the base cap relative to the dispensing opening for sealing the valve.

7. The dispensing container of claim 6 wherein the neck of the bottle is threaded and the base cap includes a threaded receptacle within the interior cavity thereof, the threaded receptacle being aligned with the through opening and the neck of the bottle for screwing the base cap to the neck of the bottle.

8. The dispensing container of claim 6 wherein the main container segment of the bottle is slightly convex shaped.

9. The dispensing container of claim 6 wherein the base cap is frusto-conical shaped.

10. The dispensing container of claim 6 wherein the travel cap is a cup shaped member having a face and a cylindrical wall extending from the face to define an interior of the travel cap, the interior of the travel cap being sized for insertion over a lower portion of the base cap to close the dispensing opening to seal the valve.

11. The dispensing container of claim 10 wherein the travel cap includes a plurality of lugs for gripping an outer surface of the base cap.

12. The dispensing container of claim 10 wherein the travel cap includes a plug sized for insertion into the through opening of the base cap to close the dispensing opening to seal the valve.

13. The dispensing container of claim 12 wherein the plug is formed of a circular ring extending from the face of the travel cap into the interior of the travel cap and includes a lip about the periphery of the ring, the lip being sized slightly larger than the through opening of the base cap for snap fitting the plug relative to the base cap.

14. The dispensing container of claim 13 wherein the lip of the plug includes a sloped insertion face and a sloped release face for snap fitting the plug through the through opening of the base cap.

15. The dispensing container of claim 1 wherein the valve is formed of a silicone membrane having a relatively small cross-slit therethrough.

16. The dispensing container of claim 15 wherein the silicone membrane is supported relative to dispensing opening between first and second ring supports, the ring supports including means for securing the ring supports relative to the dispensing opening of the container.

17. The dispensing container of claim 16 wherein one of said ring supports includes a tongue which is designed for insertion into a corresponding groove of the container for securing said ring support relative to the dispensing opening of the container.

18. The dispensing container of claim 16 wherein the container comprises a cylindrical bottle including a smaller diameter neck having a mouth for dispensing material from the inner cavity of the container and one of said ring supports includes a fit ring sized similar to the mouth of the bottle for gripping the wall of the neck of the bottle for securing the valve relative to the mouth of the container.

19. The dispensing container of claim 18 wherein the container includes a base cap having a face with a through opening, the face being aligned perpendicular to the neck and the through opening of the base cap being sized smaller than the mouth of the bottle and aligned therewith to define a stop for one of said ring supports for retaining said ring support in the mouth of the bottle for supporting the valve.

20. The dispensing container of claim 15 and further including a flow gate positioned adjacent to the silicone membrane for regulating flow of material toward the slit of the silicone membrane.

* * * * *